US006276289B1

(12) United States Patent
Wahlström

(10) Patent No.: US 6,276,289 B1
(45) Date of Patent: Aug. 21, 2001

(54) DEVICE FOR CUTTING THREAD IN A SEWING MACHINE AND USE OF THE DEVICE TO PULL DOWN THE UPPER THREAD

(75) Inventor: Rolf Wahlström, Jönköping (SE)

(73) Assignee: Viking Sewing Machines AB, Huskvarna (SE)

( * ) Notice: Subject to any disclaimer, the term of this patent is extended or adjusted under 35 U.S.C. 154(b) by 0 days.

(21) Appl. No.: 09/350,199

(22) Filed: Jul. 8, 1999

(30) Foreign Application Priority Data

Jul. 9, 1998 (SE) ..... 9802485

(51) Int. Cl.[7] ..... D05B 65/00
(52) U.S. Cl. ..... 112/292
(58) Field of Search ..... 112/285, 291, 112/292, 295, 296, 298

(56) References Cited

U.S. PATENT DOCUMENTS 3,386,402 * 6/1968 Ross ..... 12/292
4,141,307 * 2/1979 Okada ..... 112/292
4,589,362 * 5/1986 Dusch ..... 112/292
5,065,683 * 11/1991 Hayashi ..... 112/292
5,131,340 * 7/1992 Tajima et al. ..... 112/292
5,964,170 * 10/1999 Gries ..... 112/291
6,062,152 * 5/2000 Yu et al. ..... 112/291

* cited by examiner

*Primary Examiner*—Ismael Izaguirre
(74) *Attorney, Agent, or Firm*—Pearne & Gordon LLP

(57) ABSTRACT

A device for cutting of one or more sewing threads in a sewing machine, which operates with one under thread (15) and at least one upper thread (17), including a thread fetcher (18) which is displaceable to catch and bring with at least one of the threads to a cutting position, and a knife (26), which cooperates with the thread fetcher (18) to cut the thread or the threads. The thread fetcher is movable between the cutting position and at least one thread catching position to selectively catch the upper and/or the under thread. The device cooperates with the knot forming mechanism of the sewing device, whose gripper (12) brings the upper thread (17) in catching position.

Figure 1:
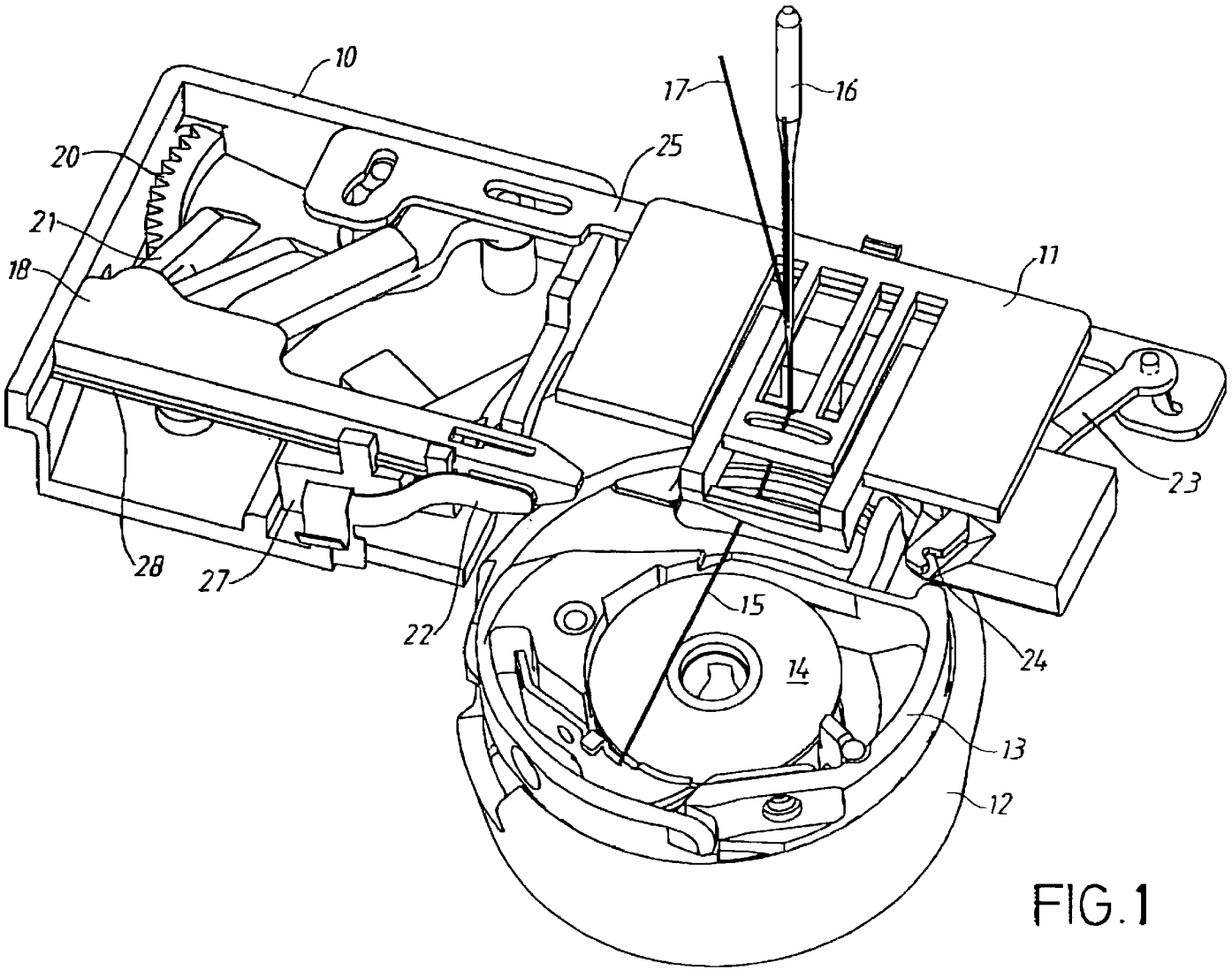

The device also enables the pulling down of the free end of the upper thread under the fabric before the sewing starts.

8 Claims, 8 Drawing Sheets

DEVICE FOR CUTTING THREAD IN A SEWING MACHINE AND USE OF THE DEVICE TO PULL DOWN THE UPPER THREAD

The present invention relates to a device for cutting one or more threads in a sewing machine, which operates with one lower thread and at least one upper thread. The invention also relates to the use of said device for pulling down the free end of the upper thread under the fabric.

Previously known devices for this purpose are characterized in that they are relatively space demanding, which is a disadvantage, especially in a household sewing machine, where the available space is limited.

One object with the invention is to provide a device for cutting thread, which device has a low space demand and therefore is suitable to use in a household sewing machine.

An other object is to achieve a device for cutting thread which is operable via the control unit of the sewing machine and has an improved function by enabling a selectable cutting of the upper and/or the lower thread.

The above mentioned objects has been achieved by means of a device of the kind mentioned in the preamble, which according to the invention is characterized in that it includes a thread fetcher arranged to catch and bring the thread or the threads to a cutting position, and a knife, which cooperates with the thread fetcher to cut the thread or the threads, and that the thread fetcher is movable between the cutting position and at least one thread catching position to selectively catch the upper and/or the lower thread.

The invention is below closer described with reference to the enclosed drawings, where:

FIGS. 1–7 show a suitable embodiment of the device according to the invention in a perspective view and in different operating positions and FIGS. 8–11 show length sections of the cutting mechanism of the device in different operating positions.

The device showed in FIGS. 1–7 consists of a part of a sewing machine and includes a housing 10 having a stitch plate 11 and a knot forming mechanism, which has a gripper 12 with a gripping basket 13, in which a shuttle 14 for the lower thread is arranged. The knot forming mechanism cooperates with a vertically movable needle provided with the upper thread 17.

A mechanism arranged in the housing 10 for catching and cutting of sewing thread includes a displaceable thread fetcher 18, which is movable between different positions, as will be closer described below. On its underside, the thread fetcher has a thread hook 19, intended to catch and bring threads which are to be cut. The thread fetcher 18 is driven by a stepping motor (not shown), which via a gear wheel affects a gear ring 20, whose movement is transferred to the thread fetcher 18 by means of a linking device 21. A thread brake 22 cooperates with the thread fetcher to hold cut thread ends. A thread catcher 23, partly situated under the stitch plate 11, is designed as a rod having a recess 24 at its one end for the catching of thread. The thread catcher 23 is displaceable between two positions and is driven from the linking device 21 via an operating rod 25.

The thread catcher 18 cooperates with a knife 26, which is mounted in a knife holder 27 arranged below the thread fetcher. The knife holder 27 is displacebly connected to the thread fetcher 18, which for this purpose has a projecting control rail 28, which interferes with the corresponding recess in the knife holder. The thread fetcher 18 has an inverted U-shaped cross section and a longitudinal track on its underside, in which track the knife 26 is arranged. Thus, the thread hook 19 of the thread fetcher consists in reality of two separated hooks having the knife 26 arranged between them. The knife holder 27 has a downwardly directed pin 29, which interferes in a corresponding recess 30 in the housing 10, whereby the knife holder is hindered to move in the direction of the thread fetcher 18. The control rails 28 of the thread fetcher 18 have at its right end, seen at the drawing, an obliquely upwardly directed part 28*a*, intended to cause a vertical movement of the knife 26, as will be described below.

In FIG. 1 the thread cutting device is shown in a non-operable starting position, as it has at normal sewing, wherein the thread fetcher 18 is in its left end position, as seen from the drawing, and the thread catcher 23 is in a retracted, inactive position.

Figure 2:
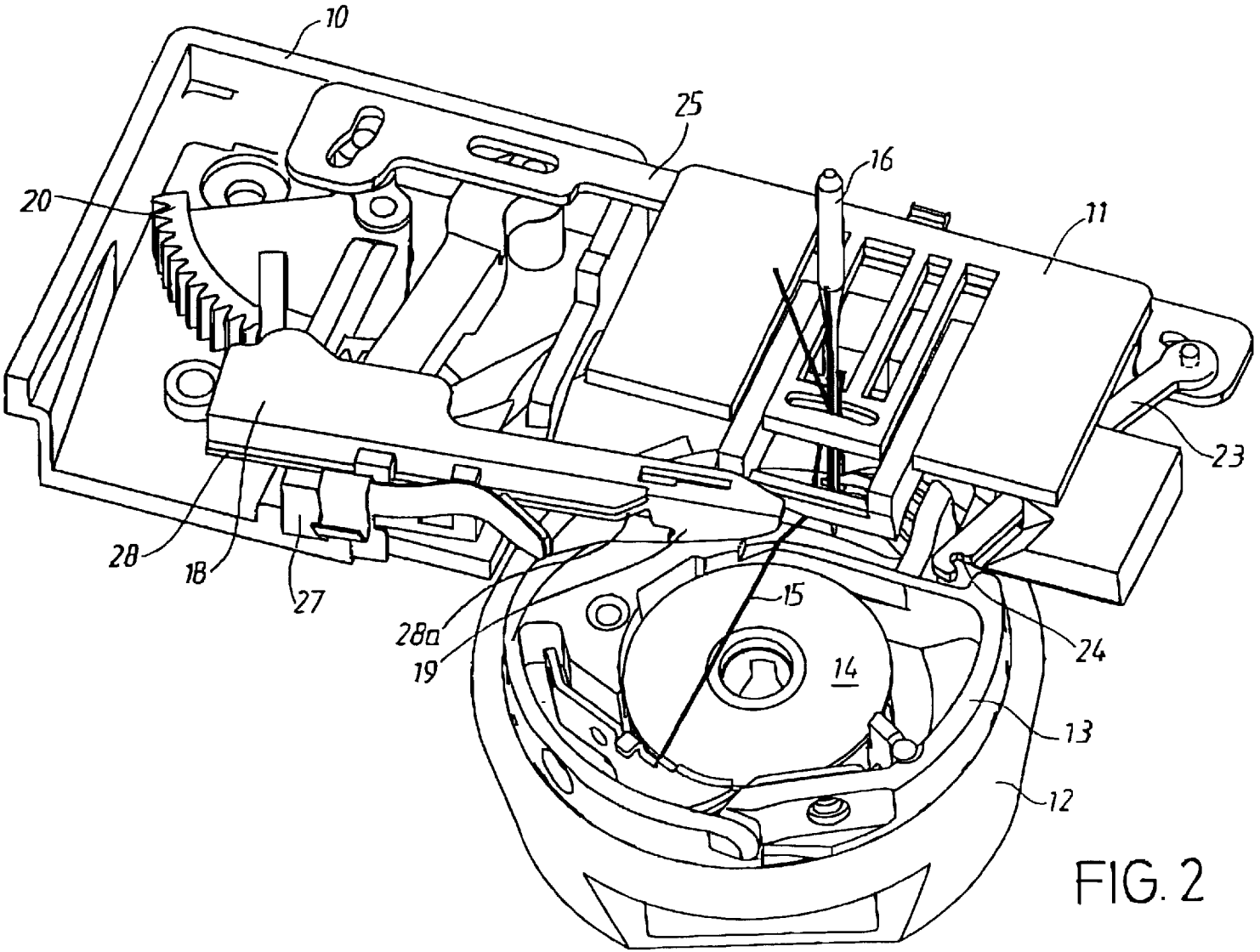

To fetch one or more threads, which are to be cut, the thread fetcher 18 is displaced to the right, as showed in FIG. 2, wherein the thread fetcher is in a position to catch the upper thread. The device simultaneously starts a cutting cycle and in FIG. 2, the needle 16 has gone down and the gripper 12 is about to catch the upper thread 17 behind the needle. The thread catcher 23 has been displaced towards the centre of the gripper 12 to an active position for catching the upper thread.

Figure 3:
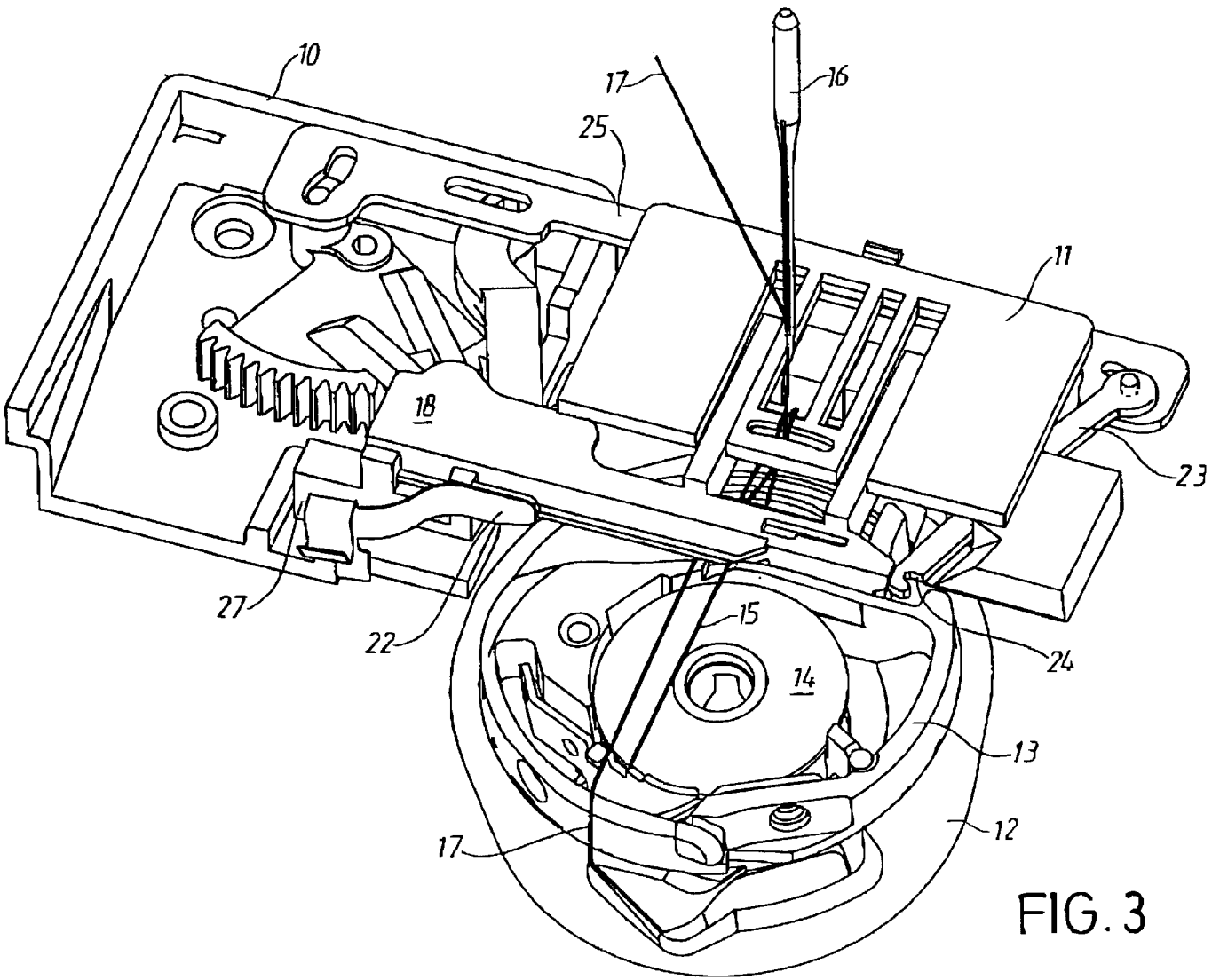
Figure 4:
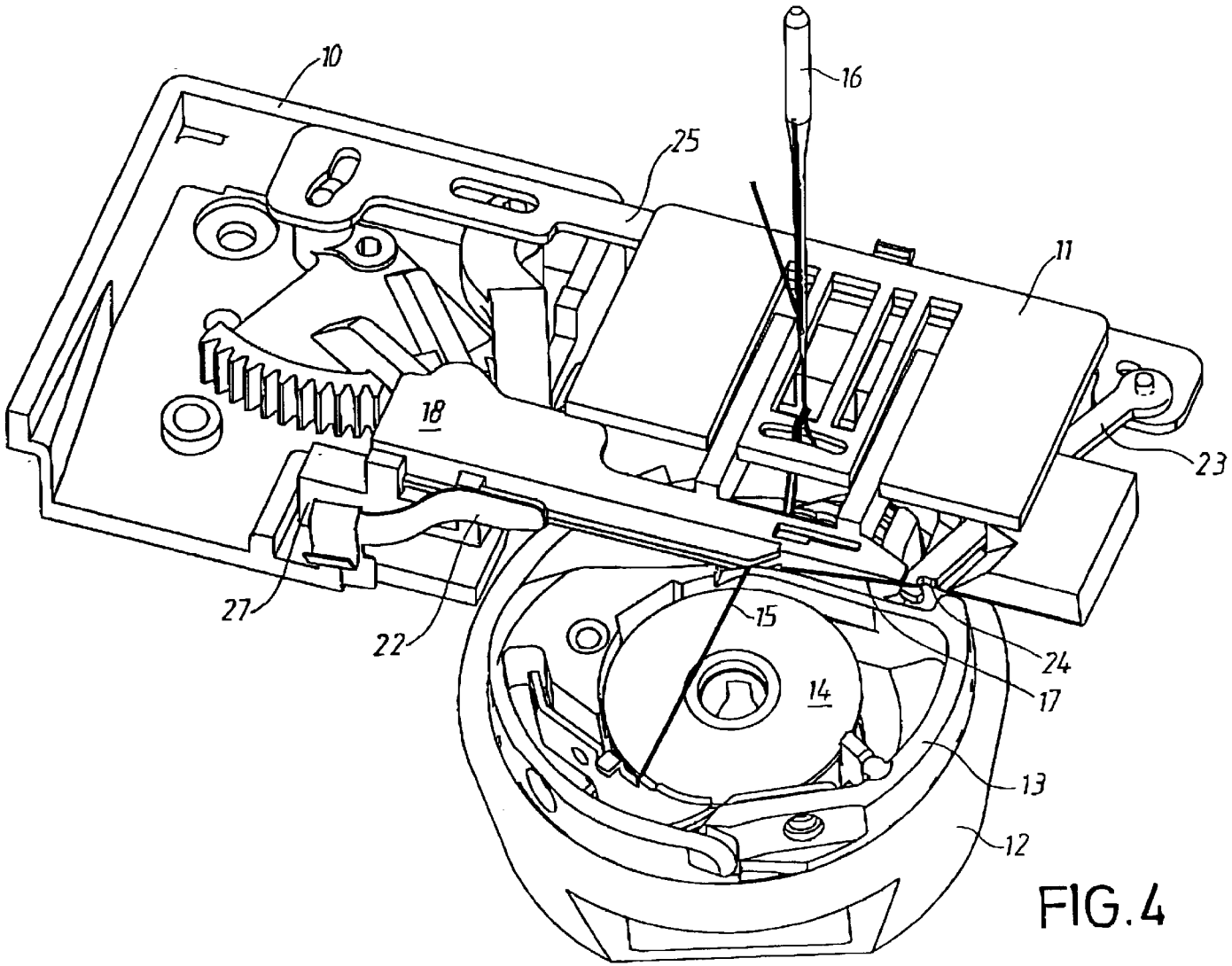
Figure 5:
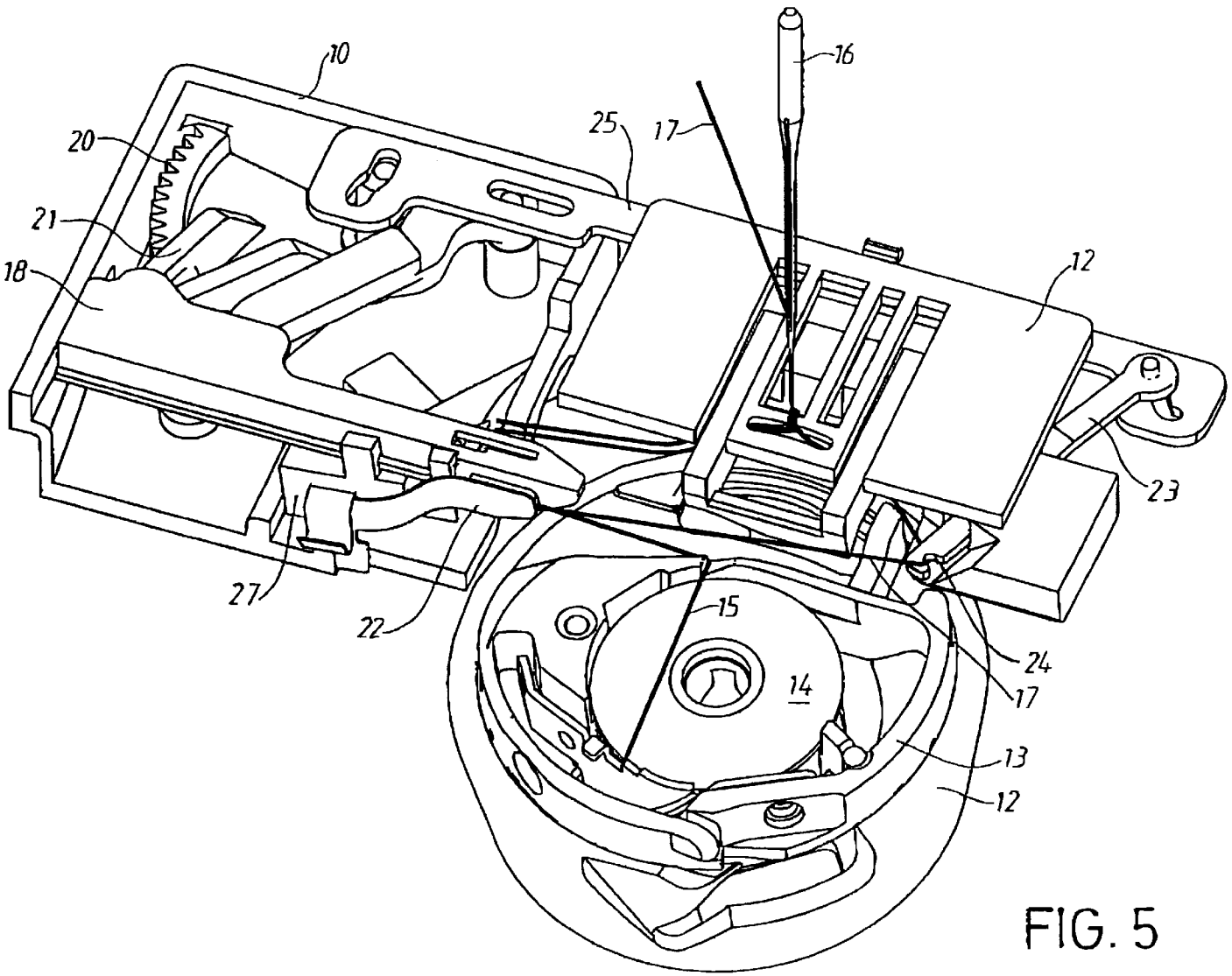
Figure 11:
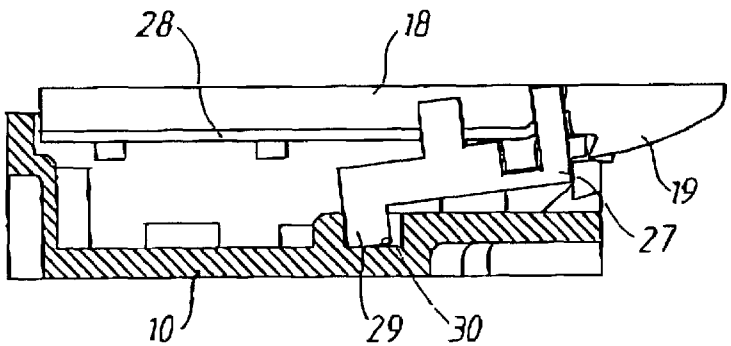
Figure 8:
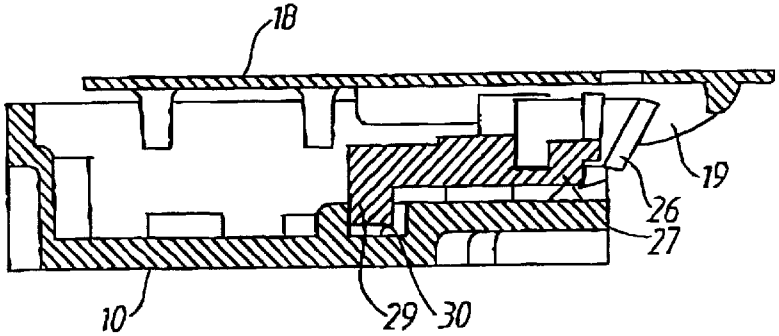
Figure 9:
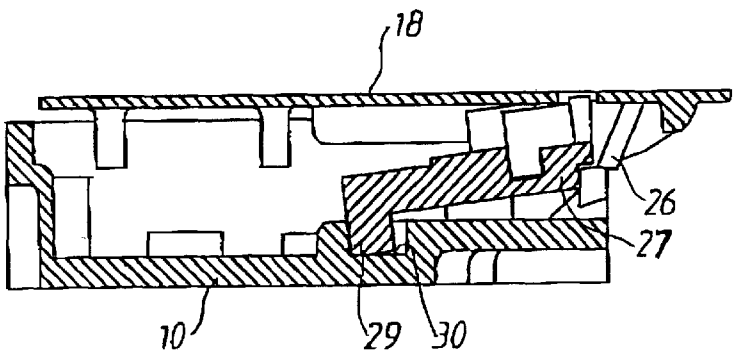

FIG. 3 the thread fetcher 18 has been further displaced a distance, to also fetch the under thread 15. The gripper 12 has rotated half a turn with the upper thread 17, which is about to be caught by the thread hook 19 of the thread fetcher 18. During the continued rotation of the gripper 12, the upper thread 17 is also being caught by the thread catcher 23 as shown in FIG. 4, where the cutting cycle of the device is completed, and the needle 16 is in its upper position and the tightener of the device (not shown) has tighten the upper thread. The thread tension is then lowered to zero, before the thread fetcher 18 returns to the starting position, as shown in FIG. 5, whereby the upper thread as well as the lower thread is brought with. When the thread fetcher approaches its end position, the threads are brought in contact with the knife 26 to be cut; see FIGS. 8 and 10. During the later par of the movement of the thread fetcher, the right part of the knife holder 27 is lifted upwardly by the oblique par 28*a* of the control rail 28, whereby the knife 26 performs a movement vertically upward and the threads are pressed against the knife simultaneously, which secures an effective cutting of the threads (FIGS. 9 and 11).

At the position in FIG. 5 the cutting of the threads is terminated, and the thread brake 22 holds tightly the thread ends remaining in the device. Since the upper thread extends around the thread catcher 23, it is secured that the remaining end of the upper thread is long enough to prevent the thread from being pulled out from the needle 16, when the next sewing operation begins. As the not shown fabric is taken away from the device, the upper thread 17 is pulled out from the thread brake 22, while the under thread is kept by the thread brake, until the beginning of the next sewing operation, which is necessary for certain kinds of threads, which otherwise tend to coil itself on the under thread shuttle 14.

Figure 6:
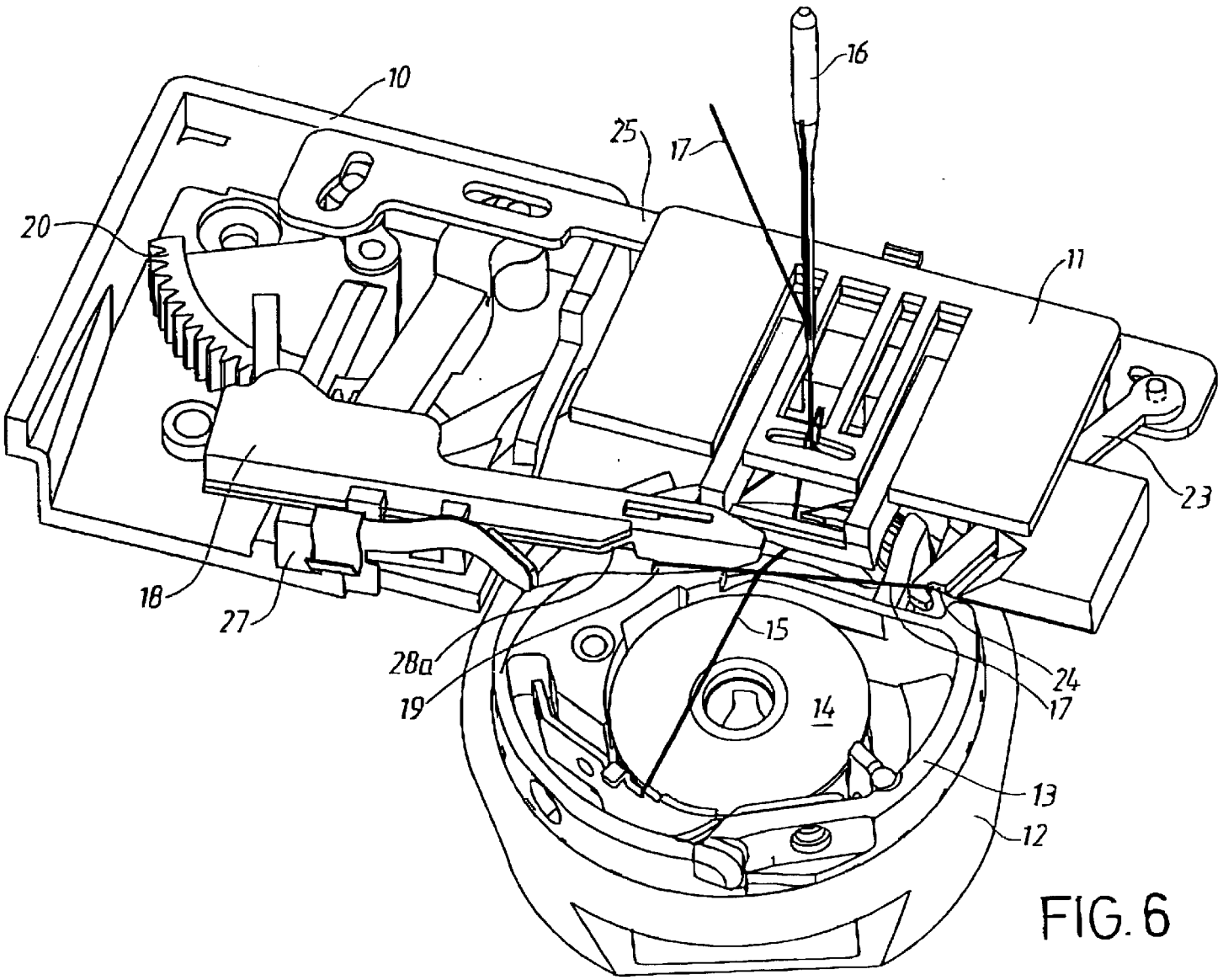
Figure 7:
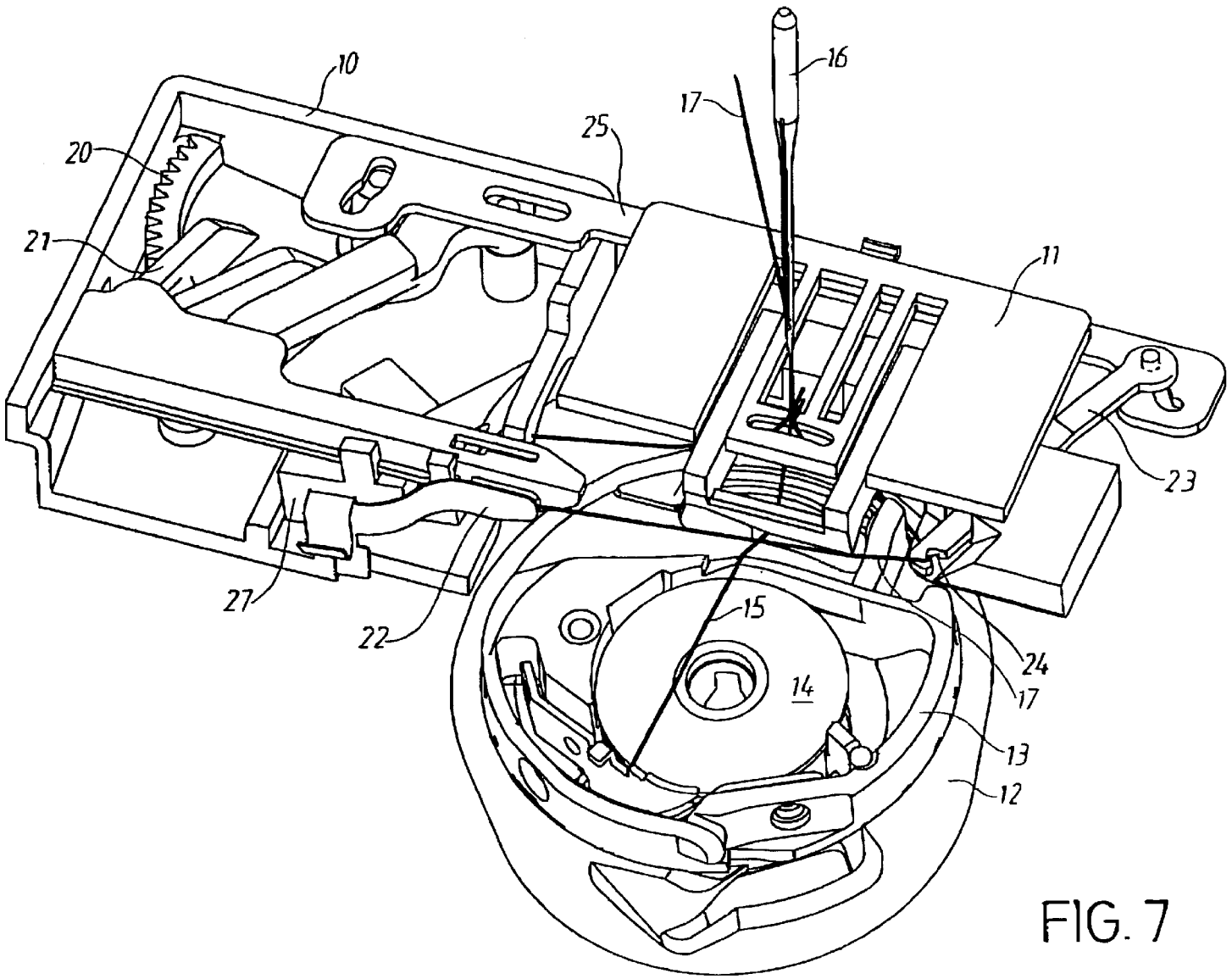
Figure 10:
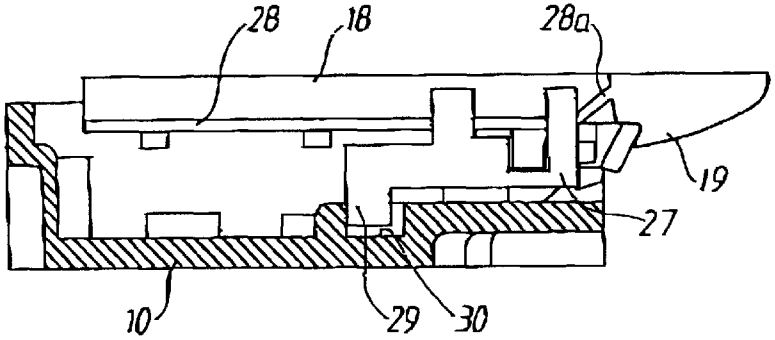

If only the upper thread 17 is to be cut, the thread fetcher 18 is displaced a shorter distance to the position in FIG. 6, whereupon the device makes a cutting cycle as described above, so that the upper thread is caught by the thread fetcher 18 and the thread catcher 23. Since the thread hook 19 of the thread fetcher has not passed the under thread 15, will this not be brought with when the thread fetcher returns to the cutting position and consequently only the upper thread is cut. FIG. 7 shows the position of the device when the upper thread just has been cut.

The described device can if desired only be used to cut only the under tread 15. The thread catcher 18 then performs the same movement as is done when cutting both threads, but the device do not make any cutting turn. The upper thread is therefor not catched and only the under thread is brought with to be cut, when the threadfetcher 18 returns to cutting position.

The described device can also be used when the machine works with more than one upper thread. Also in this case the device operates principally in the same manner, and one may select to cut either the upper or the lower thread or all threads.

The control of the different steps of the cutting operation takes place in the control unit of the sewing machine according to a predetermined program.

When decorative sewing is performed, such as embroidery sewing, it is desirable to pull down the free end of the upper thread at the underside of the fabric at the beginning and the end of each part of the sewing, in order to achieve an even upper side, which lacks free ends of thread and thereby has a more appealing appearance. When the above described thread cutting device is used, the free end of the upper thread is automatically pulled down at the end of the sewing, since the thread is cut at the underside of the fabric.

The above described thread cutting device also allows the pulling down of the free end of the upper thread, when the sewing begins, as will be described below. The procedure is somewhat different, depending on which sewing method is used.

First, the pulling down of thread is described for a sewing method including a number of sewing parts, which are performed automatically according to a predetermined program and without change of threads, wherein also the movement of the fabric is performed automatically. A typical example of such sewing is the embroidery of a series of separated figures or symbols, such as letters.

As the preceding sewing has been terminated, the machine continues to operate, and the gripper 12 catches the upper thread 17 behind the needle 16. The thread fetcher 18 is brought to the position of catching the upper thread, i.e., the position in FIG. 6, and the gripper continues to rotate, until the upper thread is being released from there. The thread fetcher 18 catches the upper thread with its thread hooks 19 and returns to a position just before the thread reaches the knife 26. The thread catcher 23 is then thrown out of function and does not catch the upper thread. The machine cycle is completed and the thread tension is lowered to zero, whereupon the thread fetcher 18 returns to the starting position and the upper thread 17 is cut. Since the thread has not been caught by the thread catcher 23, the remaining thread portion in the needle is shorter, but long enough to start a new sewing at the current automatic sewing procedure.

When the upper thread has been cut, the thread tension is raised to the normal value and the fabric is moved to the starting point for the next sewing. The gripper 12 catches the upper thread 17 behind the needle 16 and the thread fetcher 18 is displaced to the position for catching the upper thread. The machine turn is completed, and the thread fetcher catches the upper thread and returns to the starting position. The remaining free end in the needle of the upper thread is thereby pulled down to the under side of the fabric. However, a thread cutting does not take place, because said free end is too short to reach the knife 26. The new sewing may thereby begin, wherein consequently the upper thread end is not visible at the upper side of the fabric.

Below, the procedure for pulling down the upper thread end is described, when the thread cutting is performed manually before the sewing, such as by change of thread or in the beginning of embroidery sewing. The operator threads hereby the needle and cuts it with the thread knife located at the sewing head of the machine.

As been described in the above procedure, the gripper 12 catches the upper thread 17 behind the needle 16. The thread fetcher 18 is brought to a position to catch the upper thread and the gripper continues to rotate, until the upper thread is released from there. The thread fetcher 18 catches the upper thread and returns to a position just before the thread reaches the knife. The thread catcher 23 is thrown out of function and does not catch the upper thread. The machine completes the turn and performs a further stitch, whereupon the thread fetcher 18 returns to the starting position and the upper thread is being cut. The cut thread portion is removed, whereupon the sewing may begin, with the upper thread end on the under side of the fabric. Since the upper thread has not been caught by the thread catcher 23 before the cutting, the remaining thread portion is shorter, which is desirable, since a too long free thread end would cause problems, when the sewing begin, and it is also for aesthetical reasons, desirable that the visible free thread end on the underside of the fabric not is unnecessary long.

What is claimed is:

1. Device for cutting of one or more sewing threads in a sewing machine, which operates with one under thread (15) and at least one upper thread (17), wherein the device includes a thread fetcher (18) arranged to catch and bring the thread or threads to a cutting position, the thread fetcher being movable between the cutting position and at least one thread catching position to selectively catch the upper and/or the lower thread, the thread fetcher (18) having a first catching position for the catching of the upper thread (17) only, a second catching position to selectively catch either the under thread (15) only or the upper thread and under thread, a knot forming mechanism of the device including a gripper (12) arranged for selectively bringing the upper thread (17) to said first or second catching positions and a knife (26) which cooperates with the thread fetcher (18) to cut the thread or the threads.

2. Device according to claim 1, wherein the thread fetcher (18) is arranged to cooperate with the knife (26) in such way that the knife is brought in motion in the cross direction of the thread or the threads (15, 17), whereby the cutting is facilitated.

3. Device according to claim 2, wherein the thread fetcher (18) is provided with at least one control rail **(28*a*) arranged to cooperate with the knife (26)** to achieve said knife motion when cutting the thread.

4. Method of controlling start of sewing with a free end of an upper thread (17) located under a fabric in a sewing machine which operates with one under thread (15) and at least one upper thread (17) and includes a device for cutting of one or more sewing threads in the sewing machine, wherein the device includes a thread fetcher (18) arranged to catch and bring the thread or threads to a cutting position, a knife (26), which cooperates with the thread fetcher (18) to cut the thread or the threads and a knot forming mechanism including a gripper (12) arranged for bringing the upper thread or the threads (17) in a catching position, wherein the thread fetcher (18) is movable between the cutting position and at least one thread catching position to selectively catch the upper and/or the lower thread wherein the gripper (12) of the sewing machine brings the upper thread in the catching position, that the upper thread is being caught by the thread fetcher (18), and that the thread fetcher returns to the cutting position, and that the upper thread is cut or its free end is pulled down under the fabric.

5. Method according to claim 4, wherein the gripper (12) catches the upper thread (17) and brings it in catching position, that the thread fetcher (18) is displaced to its position for catching the upper thread, and that the thread fetcher catches the upper thread and returns to the cutting position before the upper thread is cut.

6. Method according to claim 5, wherein the thread tension is lowered to zero before cutting the thread.

7. Method according to claim 4, wherein the free end of the upper thread (17) before the pulling down is cut to such a length that the thread does not reach the knife (26) when the thread fetcher (18) returns to the cutting position.

8. Device for cutting of one or more sewing threads in a sewing machine, which operates with one under thread (15) and at least one upper thread (17), wherein the device includes a thread fetcher (18) arranged to catch and bring the thread or threads to a cutting position, and a knife (26), which cooperates with the thread fetcher (18) to cut the thread or the threads, and the thread fetcher (18) is movable between the cutting position and at least one thread catching position to selectively catch the upper and/or the lower thread, wherein the thread fetcher (18) is arranged to cooperate with the knife (26) in such way, that the knife is brought in motion in the cross direction of the thread or the threads (15, 17), whereby the cutting is facilitated and the thread fetcher (18) is provided with at least one control rail **(28*a*) arranged to cooperate with the knife (26)** to achieve said knife motion when cutting the thread.

* * * * *